United States Patent [19]

Ring, Sr. et al.

[11] Patent Number: 5,009,573

[45] Date of Patent: Apr. 23, 1991

[54] VARIABLE OCCLUSION PERISTALTIC APPARATUS AND METHOD

[75] Inventors: Gregg Ring, Sr., Houston; Daniel C. Soper, Buda, both of Tex.

[73] Assignee: Randolph Austin Company, Inc., Manchaca, Tex.

[21] Appl. No.: 395,940

[22] Filed: Aug. 18, 1989

[51] Int. Cl.[5] ..... F04B 43/12

[52] U.S. Cl. ..... 417/53; 417/475; 417/477

[58] Field of Search ..... 417/53, 475, 477; 604/153

[56] References Cited

U.S. PATENT DOCUMENTS

| | | | |
|---|---|---|---|
| 3,791,777 | 2/1974 | Papoff et al. | 417/475 |
| 4,043,712 | 8/1977 | Azzolini . | |
| 4,205,948 | 6/1980 | Jones . | |
| 4,484,864 | 11/1984 | Michel . | |
| 4,519,754 | 5/1985 | Minick . | |
| 4,720,249 | 1/1988 | Krebs et al. . | |

FOREIGN PATENT DOCUMENTS

| | | | |
|---|---|---|---|
| 0242077 | 10/1987 | European Pat. Off. | 417/477 |
| 2452771 | 5/1976 | Fed. Rep. of Germany | 417/477 |

OTHER PUBLICATIONS

Deublin Co. Engineering Catalog 825, 1977, page 34.

*Primary Examiner*—Leonard E. Smith
*Assistant Examiner*—Eugene L. Szczecina, Jr.
*Attorney, Agent, or Firm*—J. Nevin Shaffer, Jr.; Russell D. Culbertson

[57] ABSTRACT

A variable occlusion device includes a device housing having an occlusion track adapted to receive one or more loops of flexible tubing and having an arcuate reactive surface. The device also includes a rotor member mounted for rotation within the housing about a device axis. The rotor includes a number of carriage passageways or tracks, each passageway or track with an occluding member carriage and occluding member assembly movably mounted therein. The carriage and occluding member assemblies are each adapted to move between an extended position in which the occluding member bears against and collapses the tubing received in the occlusion track, and a retracted position in which the occlusion member is drawn away from and out of contact with the tubing in the occlusion track. The peristaltic device also includes a fluid distribution system for providing an operating fluid from a remote fluid supply under a desired pressure to the carriage passageways of the rotor. The operating fluid is used to control both the occluding force exerted by the occluding members upon the tubing and the position of the occluding members. In the preferred form of the invention, operating fluid containment bags are positioned within each carriage passageway or track for containing the operating fluid, which may be suitable gas, so that it may apply the desired occluding force but does not directly contact either the fluid passage walls or the carriage member. Also, the desired fluid pressure is preferably communicated to the carriage passageways or tracks through a rotary union with no rotating seals apart from a sealing bearing structure.

18 Claims, 4 Drawing Sheets

VARIABLE OCCLUSION PERISTALTIC APPARATUS AND METHOD

BACKGROUND OF THE INVENTION

The invention relates to peristaltic devices, and particularly to a variable occlusion peristaltic device that provides a constant occluding pressure.

Peristaltic devices are commonly used as pumps for pumping a fluid while keeping the fluid isolated from potential contaminants. Such peristaltic pumps find application in medicine, food, and pharmaceutical processing, and in painting or coating systems. Peristaltic devices are also employed as meters for metering the volume of fluid flow through a conduit and as motors for turning a shaft.

Regardless of the particular application, peristaltic devices include generally a housing with an arcuate roller or occlusion track defined therein and a rotor mounted in the housing for rotation about the longitudinal axis of the roller or occlusion track. A number of occluding members or rollers are mounted on the rotor and adapted to engage and compress a resilient and flexible tubing contained in the roller or occlusion track.

When used as a pump, for example, a motor is connected to drive the rotor about its rotational axis. As the rotor rotates, the rollers or other occluding members are repetitively brought to bear against the tubing extending through the housing, compressing or collapsing the tubing against the occlusion track, and urging the fluid or other material contained in the tubing forward in the direction of the occluding member motion relative to the tubing. The occluding members could be used to partially collapse the tubing or to completely collapse the tubing, in the latter case forming isolated slugs of fluid in the tubing between occluding members.

There were a number of problems associated with prior peristaltic devices, some problems being accentuated by the particular desired function of the device. First, the tubing upon which the peristaltic device operated had to be looped or loaded through the housing in order for the device to operate, and such loading was difficult where the occluding members remained in a fixed occluding position in the housing. Thus, there has been a need for means of varying the position of the occluding members quickly, particularly from a remote location. Also, prior peristaltic devices were not capable of maintaining a constant occluding force on the tubing during operation, regardless of the pressure of the fluid passing through the tubing. Finally, where the peristaltic device was to be used in a controlled clean environment, the preferred variable occluding force had to be applied without the use of potentially contaminating material such as hydraulic fluid.

U.S. Pat. No. 4,720,249 to KREBS et al. is directed to a peristaltic pump with enhanced tube loading features. KREBS et al. show several different mechanisms for varying the position of the occluding members of a peristaltic pump from an extended occluding position to a retracted loading position. In the retracted position, all of the occluding members were withdrawn inwardly into a centrally positioned rotor away from the occlusion track so as to provide room for inserting or withdrawing the tubing. In one preferred form of the KREBS et al. device, a hydraulic system contained in the rotor was used to control the position of the occluding rollers.

Although KREBS et al. do disclose means for withdrawing occluding members for purposes of loading and unloading tubing, the position of the rollers could not be controlled remotely. Furthermore, the hydraulically operated variable occlusion system required hydraulic fluids which are undesirable for use in certain controlled environments. Also, the KREBS et al. variable occlusion system did not provide a constant occluding force on the tubing during operation. Once the KREBS et al. rollers were hydraulically set in the extended position, any change in the pressure of the fluid in the tubing changed the force applied between the occluding members and the tubing. Finally, the KREBS et al. device did not enable the occluding force to be increased or controlled while the pump was operating to ensure that the tubing remained completely collapsed.

SUMMARY OF THE INVENTION

It is a general object of the invention to provide a variable occlusion peristaltic apparatus and method adapted to overcome the above problems and others associated with prior peristaltic devices.

A variable occlusion peristaltic device according to the invention is adapted for controlling and varying the occlusion with force applied through an operating fluid which is supplied at a desired operating pressure from a source outside of or remote from the peristaltic device housing. Since the operating fluid is supplied at the desired operating pressure remotely from the housing, the occlusion and occluding force may be varied and controlled remotely, and during operation of the peristaltic device. The peristaltic device according to the invention thus need not be stopped in order to vary the occlusion or occluding force.

Furthermore, the peristaltic device according to the invention is uniquely adapted for utilizing a gas such as air as the operating fluid. The use of a gas operating fluid provides several advantages. First, the use of a gas operating fluid eliminates the requirement of a hydraulic fluid within the peristaltic device, hydraulic fluid being undesirable for use in certain controlled clean environments. Also, the use of a gas as an operating fluid allows for quicker change of the occluding force.

An advantage of particular importance with the variable occlusion peristaltic device of the invention is that the occluding force remains constant regardless of the pressure of material in the tubing that is being occluded or collapsed by the peristaltic device occluding members. The occluding force exerted by the occluding members on the tubing remains constant because the occluding force is supplied through the operating fluid at a particular operating pressure which can be maintained at a regulated substantially constant level. This substantially constant occluding force feature makes the variable occlusion peristaltic device according to the invention particularly useful in applications where output pressure from the peristaltic device must be maintained at a critical level.

The variable occlusion peristaltic device according to the invention includes a housing with an occlusion track defined therein having a generally arcuate reactive surface. A flexible and resilient tubing is adapted to be received or looped through the housing in the occlusion track with the tubing entering the housing through a tubing inlet and exiting through a tubing outlet. A rotor member is mounted for rotation in the device about the longitudinal axis of the occlusion track arcuate reactive surface. The preferred form of the invention, which may be used as a pump, also includes a rotor driving motor connected to the rotor member through a suitable rotor drive shaft assembly for rotating the rotor member with respect to the housing occlusion track and the tubing therein. The rotor member includes a plurality of carriage passageways extending preferably radially with respect to the rotor rotational axis and at different angular orientations about the rotor rotational axis. A carriage member is mounted within each carriage passageway and adapted to move along the passageway. Also, each carriage has mounted thereon, an occluding member, preferably an occluding roller adapted to contact and occlude the tubing extending through the occlusion track as the carriage moves radially toward the occlusion track through the carriage passageway.

In operation, the carriage members, carrying the preferred occluding member, are adapted to move between an extended position within the carriage passageway and a retracted position in the carriage passageway. In a completely extended position, the carriage member is extended so that the occluding member mounted on the carriage completely collapses the tubing received in the occlusion track against the arcuate reactive surface. In a completely retracted position, the carriage member is retracted along the passageway so that the occluding member is pulled away from the occlusion track and the tubing extending therethrough so that the tubing may easily be removed and other tubing inserted into the track. With the carriage members in an extended position so that the occluding members bear against the tubing in the occlusion track, the rotor may be driven by the rotor driving motor so that the plurality of occluding members travel along the tubing successively and repetitively to compress the tubing locally and create a peristaltic action.

According to the invention, an operating fluid distribution means is provided for providing operating fluid at a desired operating pressure from outside the housing through the rotating rotor, to each carriage passageway. The operating fluid pressure bears against the carriage member in each passageway preferably through an expandable operating fluid containment means positioned in the passageway to apply the desired occluding force to the tubing in the occlusion track.

Each expandable containment means preferably includes a bag made of flexible and resilient material with an open end sealed by suitable means and positioned in one of the carriage passageways, at the end thereof, furthest from the occlusion track to receive operating fluid. Each bag also includes a preferably planar first end adapted to bear against a reactive surface on the carriage member, and pleating means formed in the sides of the bag between the first end and the sealed second end. The unique pleated section or means enables the length of the bag between the planar first and sealed second ends to change while maintaining the planar end of the bag against the carriage member so as to distribute the force of the operating fluid evenly over the reactive surface of the carriage member. The pleating section also allows the distance between the two ends of the bag to increase without causing the bag material to stretch. The expandable containment means may be utilized with any operating fluid but is particularly adapted for use with a gas operating fluid such as air. Particularly when used with a gas operating fluid, the containment means eliminates the sealing difficulties found in cylinder and piston arrangements and also eliminates problems resulting from the required lubrication in such cylinder and piston arrangements.

The operating fluid distribution means according to the invention includes a suitable conduit or passage extending through the rotor and rotor drive shaft upon which the rotor is driven by the rotor drive motor. A connecting passage is adapted to extend from the rotor shaft conduit or passage to the end of each carriage passageway furthest from the occlusion track to provide fluid communication from the rotor shaft conduit to the operating fluid containment bag in each carriage passageway. The operating fluid distribution means also includes a rotary operating fluid union adapted to be connected to the rotor drive shaft for supplying the operating fluid to the conduit or passage in the rotating shaft. An operating fluid supply means connected to the rotary fluid union by a suitable conduit supplies the operating fluid at the desired operating pressure to the union and ultimately to the operating fluid containment bags for providing the desired occluding and positional force.

The rotary operating fluid union according to the invention is specifically adapted to supply an operating fluid from the operating fluid source to the conduit or passage through the rotating rotor shaft for extended periods of service and without substantially contaminating the fluid with lubricating agents. The preferred union includes an elongated outer union body rotatably and sealingly connected to an elongated inner union body. The outer union body has a longitudinal inner opening adapted for receiving the inner union body and having a center portion with a cylindrical surface. The inner union body includes a shaft opening extending longitudinally therethrough for receiving the rotor shaft, and a center portion with a cylindrical outer surface adapted to align with the center portion of the outer union body. Two sealed bearings, one positioned at either end of the aligned center portions, suspend the inner union body for rotation within the outer union body with the respective central cylindrical surfaces of the two bodies aligned and spaced a very small distance from each other.

The rotary union also includes fluid communication means preferably formed entirely within the center portions of the two union bodies for providing constant fluid communication transversely through the two union bodies. In the preferred form of the invention, the fluid communication means includes an inlet port extending transversely through the center portion of the outer union body and an outlet port extending transversely through the center portion of the inner union body. To ensure constant fluid communication between the inlet and outlet port as the inner union body rotates with respect to the outer union body, a circumferential fluid communication groove is formed between the two union bodies. The fluid communication groove is positioned so that it is in constant contact with both the inlet and outlet ports through the union regardless of the angular rotation or position of the inner union body with respect to the outer body.

In operation, the operating fluid is supplied under the desired operating pressure to the inlet port of the rotary union which is always in fluid communication with the groove between the two union bodies. The union outlet port which is also always in communication with the fluid communications groove supplies the operating fluid under the desired pressure through the inner union body to a radial connecting conduit on the rotor drive shaft which leads to the conduit within the rotor shaft. Leakage from the rotary union is controlled and limited by the close tolerance between the two aligned cylindrical center portions of the union bodies and by the sealed bearings secured at either end of the two aligned cylindrical center portions. Where leakage is not desired or allowable, the sealed bearings may be sealed by suitable stationary sealing means to both the inner and outer union bodies to form a substantial seal on either end of the union.

A primary advantage of the rotary union according to the invention is that no separate rotating seal is required between the surfaces of the inner and outer union bodies, and the required lubrication is contained within the two bearings which include the only rotating seals in the union. Thus the rotary union according to the invention is adapted to provide a clean operating fluid from an external fluid source to a rotating member for extended periods of use without substantial maintenance.

These and other objects, advantages, and features of the invention will be apparent from the following description of the preferred embodiments, considered along with the accompanying drawings.

DESCRIPTION OF THE PREFERRED EMBODIMENTS

Figure 1:
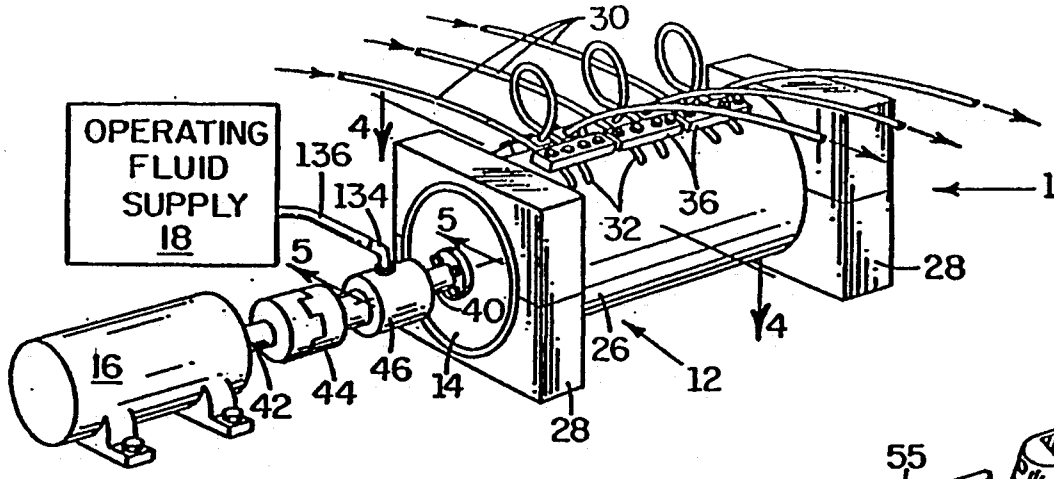
FIG. 1 is an isometric drawing of a variable occlusion peristaltic device embodying the principles of the invention.

FIG. 1 illustrates one preferred form of peristaltic device 10 embodying the principles of the invention. The peristaltic device 10 includes a device housing 12 and a rotor 14 mounted for rotation within the housing and adapted to be driven by a motor 16. The peristaltic device 10 also includes an operating fluid supply means 18, illustrated schematically in FIG. 1, adapted for supplying a suitable operating fluid at a desired operating pressure to the rotor 14.

Figure 3:
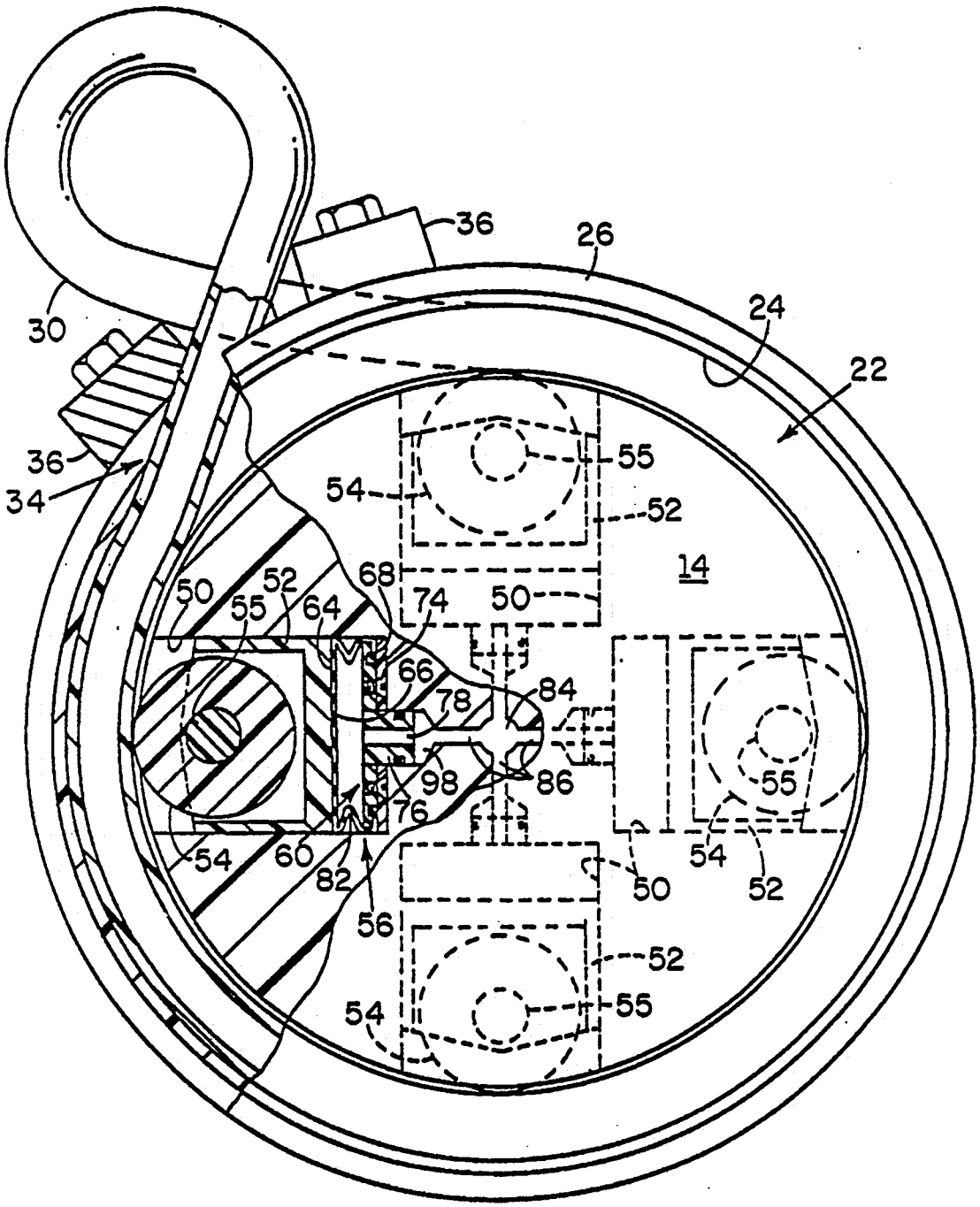
FIG. 3 is a partially cut away transverse section of the device shown in FIG. 1, showing the occluding member carriages in a retracted position.
Figure 4:
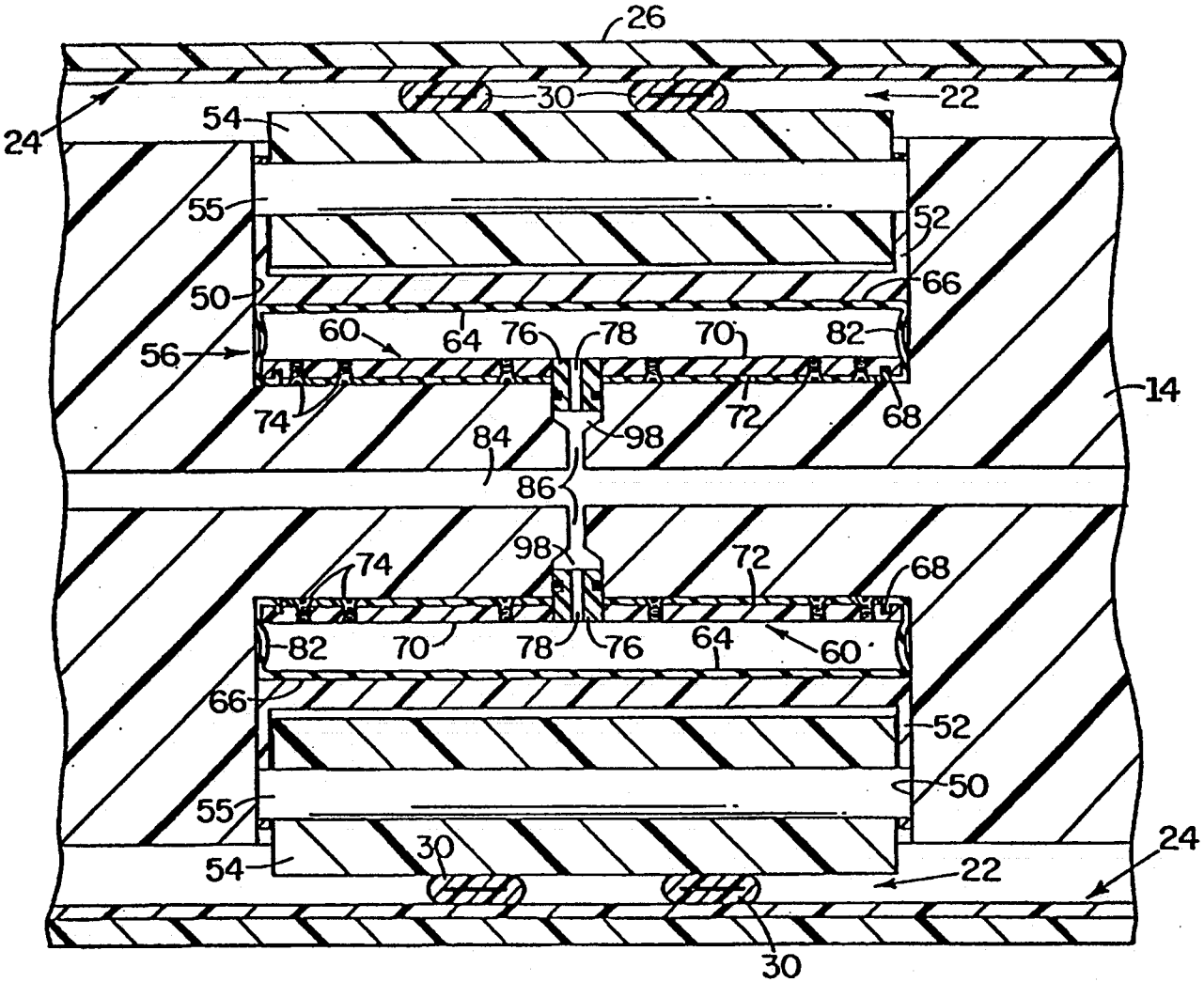
FIG. 4 is a partial view in longitudinal cross section taken along line 4—4 in FIG. 1, showing the occluding member carriages in an extended position.

The device housing 12 includes an occlusion track generally indicated at 22 in FIGS. 3 and 4 that includes a generally arcuate reactive surface 24. In the form of the invention illustrated in FIG. 1, the occlusion track 22 is formed within an elongated cylindrical member 26 extending between two housing supports 28. The housing 12 may be made of any suitable substantially rigid material and is preferably formed from a suitable plastic. The primary function of the device housing 12 is to provide the occlusion track 22 circumferentially adjacent to the rotor 14. However, it will readily be appreciated by those skilled in the art that the device housing may serve other functions and take many other forms within the scope of the invention. For example, the housing 12 may also preferably include means (not shown) for mounting the drive motor 16 so that the entire peristaltic device 10, excluding the operating fluid supply 18, can be easily transported as a single unit. Also, although the reactive surface 24 in the illustrated form of the invention is formed on the inside surface of the cylindrical member 26 with the rotor 14 adapted to rotate within the cylindrical member, in other forms of the invention the reactive surface may be an outer surface of a generally cylindrical member and the rotor adapted to rotate outside of the cylindrical member.

As shown particularly in FIGS. 1, 3, and 4, the occlusion track 22 in the device housing 12 is adapted to receive one or more loops of tubing or profile 30. Preferably, each loop of tubing 30 enters through a separate tubing inlet 32 extending through the housing and exits through a separate tubing outlet 34 (FIG. 3). Also, a suitable clamping means 36 is provided both at the tubing inlet 32 and 34 outlet for securing the tubing 30 in place within the housing 12 so as to prevent movement by the tubing in response to the occluding action provided through the rotor 14. As shown in FIG. 1, each length of tubing received in the device housing may be looped more than once through the occlusion track 22 to provide more occlusion points along the tubing. The tubing or profile is preferably made from a suitable resilient and flexible material capable of being collapsed and then returned to its normal shape repeatedly.

The rotor 14 in the illustrated form of the invention is a generally elongated cylindrical piece of material mounted in the housing for rotation about its longitudinal axis. The rotor 14 is adapted to be rotated by a rotor drive shaft 40 connected directly to the rotor 14 and preferably coupled to a drive motor shaft 42 by a suitable shaft coupling 44 (FIG. 1). Also, a unique rotary fluid union 46 is connected to the rotor drive shaft 40 for enabling fluid communication between the operating fluid supply means 18 and a conduit 88 (FIG. 5) extending through the rotor shaft.

Figure 2:
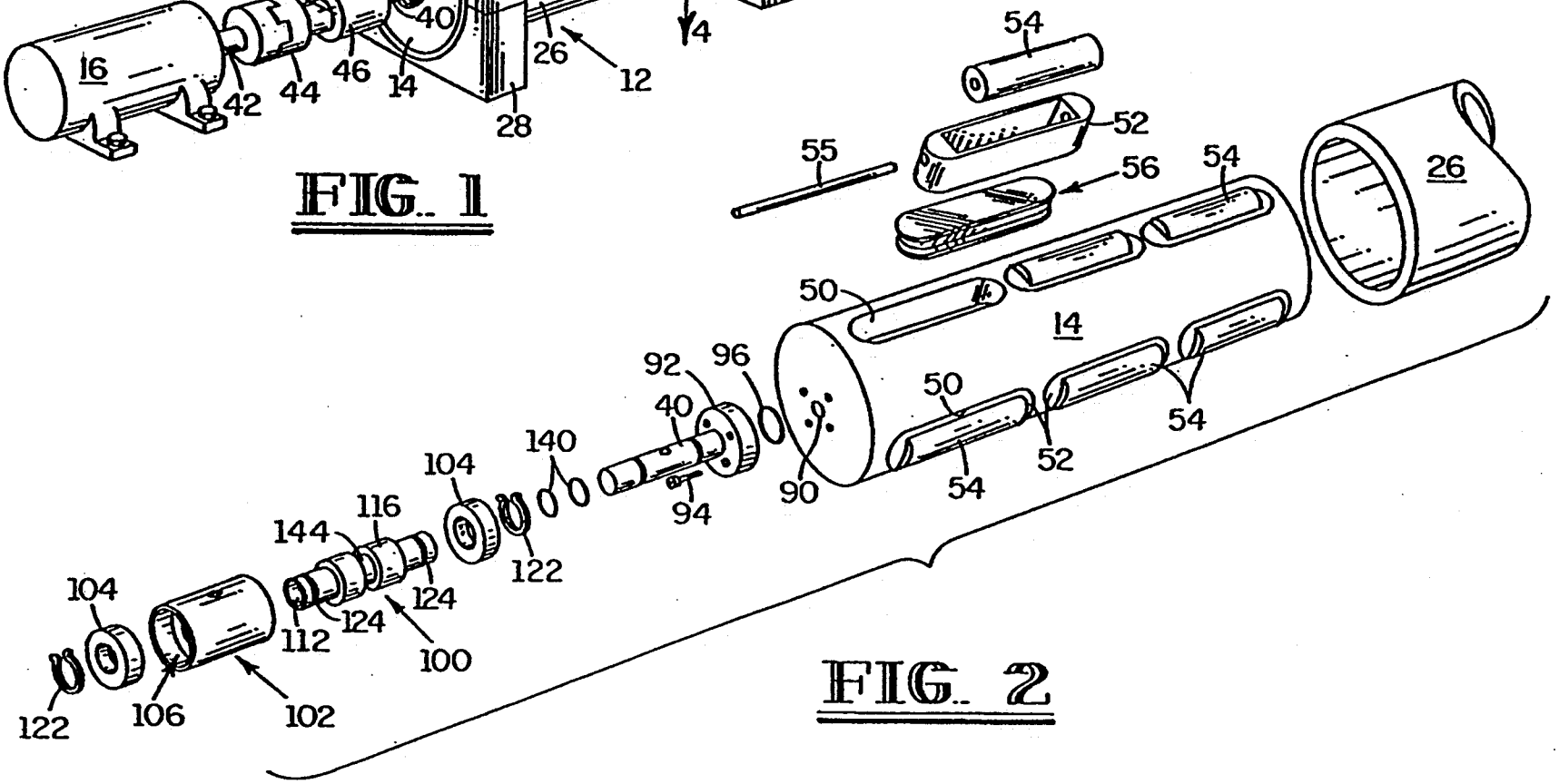
FIG. 2 is an exploded isometric drawing of the peristaltic device shown in FIG. 1.

As shown in FIGS. 2, 3, and 4, the cylindrical rotor 14 includes a plurality of carriage passageways 50 which, in this form of the invention, extend outwardly from the rotational axis of the rotor toward the occlusion track reactive surface 24 in the device housing 12. The illustrated passageways 50 are each oblong in shape with the major axis extending parallel to the rotational axis of the rotor. An occluding member carriage 52 having a corresponding oblong shape is positioned in each carriage passageway 50 and adapted to move between a fully retracted position, in this form of the invention, inward toward the rotational axis of the rotor, and a fully extended position (FIG. 4) toward the reactive surface 24 of the housing 12. Also, an occluding member, preferably a roller 54, is mounted by suitable means such as roller pins or axles 55 on each occluding member carriage 52 for rotation about an axis that extends parallel to the longitudinal or rotational axis of the device. Each roller 54 is positioned on its carriage member 52 such that when the particular carriage member is moved to the fully extended position within the carriage passageway 50, the occluding roller is adapted to contact the tubing or profile 30 in the occlusion track 22 and to fully collapse the tubing against the reactive surface 24 as shown in FIG. 4. However, when in a fully retracted position, the occluding roller 54 is not in contact with the tubing 30 so that the tubing may be easily removed and new tubing inserted into the occlusion track.

Again, although the Figures illustrate the preferred rotor, many rotor variations are possible within the scope of the invention. For example, although the carriage passageways 50 and carriage members 52 are shown with a generally oblong shape, many other shapes may be used. Also, although the illustrated rotor includes four carriage passageways 50, each with a carriage member 52 mounted therein, more or fewer carriage passageways may be utilized in a particular peristaltic device according to the invention. Furthermore, as shown in FIG. 2, the illustrated rotor 14 includes three sets of longitudinally spaced occluding members and carriage passageways although more or fewer sets may be used according to the invention.

Referring again to FIGS. 2, 3, and 4, expandable operating fluid containment means, generally indicated by reference number 56, are provided within each carriage passageway 50 and positioned so that the carriage member 52 is located between the particular operating fluid containment means and the reactive surface 24 of the housing 12. In the illustrated form of the invention, each expandable operating fluid containment means 56 comprises a containment bag made of a suitable resilient and flexible material. The containment means or bag 56 includes a planar first end section 64 adapted to bear against a planar reactive surface 66 on the movably mounted carriage 52 in the particular carriage passageway 50 and an open end 60. The open end 60 of the containment bag 56 includes a turned in sealing lip 68 that is adapted to be sealingly secured between inner and outer containment bag base plates, reference numbers 70 and 72 respectively (FIG. 4), the two plates being secured together by suitable means such as machine screws 74 and forming a second end section. The containment means or bag 56 also includes a fluid access fitting 76 with an access opening 78 mounted on the second end section formed by the base plates 70 and 72, the fitting being adapted to sealingly connect to the rotor 14 for providing fluid communication between the rotor and the fluid containment means.

According to the invention, the containment bag 56 also includes a pleated portion formed on the sides or side members thereof. The illustrated pleated portion includes a single pleat ridge 82 that extends inwardly into the area of the containment bag 56 between the planar first end 64 and the sealing base plates 70 and 72 at the bag open end 60. However, in other forms of the invention, several inwardly extending pleat ridges may be used. The pleated section enables the planar first end 64 of the containment bag 56 to remain flush against the planar reactive surface 66 of the adjacent carriage member 52 as the bag expands and contracts. Thus, the force of the operating fluid within the operating fluid containment bag 56 is evenly distributed over the carriage reactive surface 66 over substantially the entire range of movement of the carriage 52 within the carriage passageway 50. Also, the pleated section allows the containment bag 56 to expand without stretching the bag material substantially along the sides of the bag.

With the expandable operating fluid containment means 56 of the invention, the operating fluid does not directly contact the walls of the carriage member passageways 50 or the carriage members 52. Therefore, no special sealing arrangement is required between the walls of each carriage member passageway 50 and the particular carriage member 52 adapted to move through the passageway. The expandable operating fluid containment means 56 also eliminates much of the lubrication required by prior cylinder and piston arrangements.

The peristaltic device 10 according to the invention also includes operating fluid distribution means for providing the particular operating fluid under the desired operating pressure to each operating fluid containment means 56 mounted within the rotor 14. By controlling the pressure of the operating fluid in the operating fluid containment means 56, the position of the occluding members 54 and the force exerted by each occluding member on the tubing 30 can be closely and remotely controlled. With the operating fluid being supplied at a particular operating pressure, the occluding force supplied to the tubing 30 by each occluding member 54 remains substantially constant regardless of the pressure of fluid in the tubing.

Figure 5:
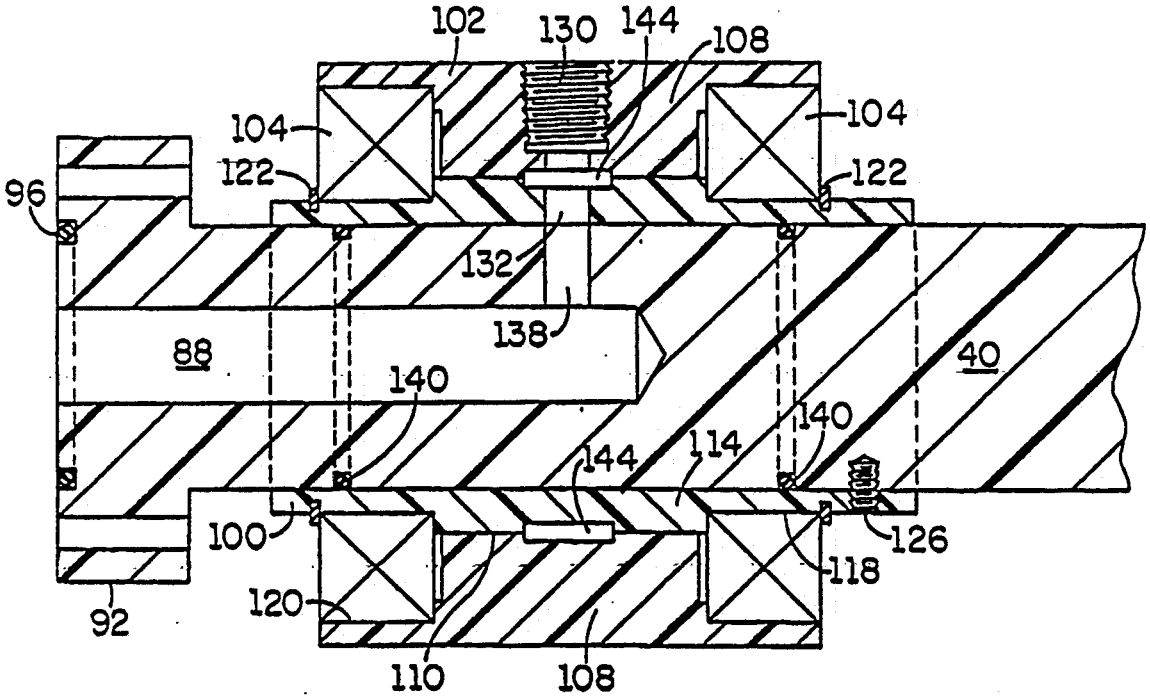
FIG. 5 is a view in longitudinal cross section of the rotary union taken along line 5—5 of FIG. 1.

The illustrated preferred operating fluid distribution means includes the operating fluid supply means 18 shown in FIG. 1, the rotary fluid union 46 shown in FIGS. 1, 2, and 5, a primary operating fluid passage 84 extending through the rotor 14, and a plurality of connecting fluid passages 86, each connecting passage extending from the primary passage to a different carriage passageway 50. Also, a suitable shaft conduit 88 (FIG. 5) is provided through the rotor shaft 40 on which the rotary union 46 is mounted for providing a conduit from the rotary union to the rotor primary passage 84.

The operating fluid supply means 18 may be any suitable device adapted to provide a fluid under a closely regulated pressure within a suitable operating pressure range. Although a liquid operating fluid may be used according to the invention, the expandable operating fluid containment means or bag 56 according to the invention is uniquely suited for use with a gas operating fluid. Thus the operating fluid supply means 18 may be adapted for supplying a suitable gas such as air. In the preferred form of the invention, the operating fluid supply device 18 is adapted to provide operating fluid at positive gauge pressure to extend the carriages 52, and also at negative gauge pressure for withdrawing the carriages to the retracted position. In the illustrated preferred form of the invention, shown particularly in FIGS. 3 and 4, the primary passage 84 in the rotor 14 extends longitudinally through the center of the rotor from an inlet end 90 adapted to be connected to the rotor drive shaft 40. A suitable flange 92 with flange bolts 94 connects the rotor 14 and rotor drive shaft 40 using an "O" ring 96 to form a seal between the primary rotor passage 84 and the rotor drive shaft conduit 88. The preferred connecting passages 86 in the rotor 14 each include a receptacle or connector opening 98 into one of the carriage passageways 50 adapted to receive the preferred fitting 76 of the expandable containment means 56.

Referring to FIGS. 2 and 5, the preferred rotary union 46 is adapted for providing clean operating fluid from a remote operating fluid source such as fluid supply 18 to a rotating member, in this case, the rotor drive shaft 40. The rotary union 46 includes an inner union body 100 suspended for rotation within an outer union body 102 by two sealed bearing means 104. The rotary union 46 also includes fluid communication means formed in the two union bodies 100 and 102 between the bearings 104. The fluid communication means provide continuous fluid communication transversely through the two union bodies 100 and 102 while the close tolerance between the union bodies and the bearings 104 reduce leakage of operating fluid to an allowable level or provide a substantial seal at either end of the union.

The outer union body 102 includes a longitudinal inner opening 106 having a center portion 108 with a substantially cylindrical surface 110. The inner union body 100 includes a shaft opening 112 extending longitudinally therethrough for receiving the rotating member (drive shaft 40), and a center portion 114 having a cylindrical outer surface 116.

As shown best in FIG. 5, the inner union body 100 is adapted to be received within the outer union body 102 with the center portions 108 and 114 of each body generally aligned and with a very small clearance therebetween. The bearings 104 are tightly received in bearing grooves 118 and 120 on either end of the inner and outer bodies 100 and 102, respectively, such that the inner body may freely rotate with respect to the outer body about its longitudinal axis. Bearing retainer rings 122 are adapted to snap into bearing retainer grooves 124 to retain the bearings 104 in place on either side of the aligned center portions of the two union bodies 100 and 102. FIG. 5 also clearly shows the assembled rotary union 46 secured to the rotor drive shaft 40, the shaft being received through the shaft opening 112 of the inner union body 100 and secured to the inner union body with set screw 126.

Referring still to FIG. 5, the fluid communication means includes on inlet port 130 extending transversely through the center portion 108 of the outer union body 102 and at least one outlet port 132 extending transversely through the center portion 114 of the inner union body 100. An inlet connector fitting 134 (FIG. 1) is preferably connected to the inlet port 130 for providing an easy connection to a conduit 136 from the operating fluid supply 18. The outlet port 132 is adapted to align with a radial passage 138 on the rotor shaft 40 when properly connected thereto with the set screw 126, and suitable "O" ring seals 140 may be positioned on either side of the radial passage to form a seal between the inner union body 100 and the shaft.

A fluid communication groove 144, formed between the center portions 108 and 114 of the two union bodies 102 and 100, is also included in the fluid communication means of the invention. The fluid communication groove 144 extends around the entire circumference of the aligned union body center portions 108 and 114 so as to provide constant fluid communication between the inlet and outlet ports, 130 and 132 respectively, regardless of the rotation of the inner union body 100 with the shaft 40. It should be noted that although the fluid communication groove 144 is shown formed in both the inner and outer union bodies 100 and 102, a suitable groove may alternatively be formed in just one of the union bodies. The primary requirement of the fluid communication groove 144 is that it be positioned so as to contact both the inlet port 130 and the outlet port 132 to provide the desired fluid communication constantly as the inner body 100 rotates.

In operation, operating fluid reaches the rotor drive shaft conduit 88 through the inlet port 130, the communication groove 144, the outlet port 132, and then the shaft radial passage or conduit 138. It will readily be appreciated from the figures that the inner union body 100 is suspended for rotation within the outer union body 102 with no rotating seals apart from the sealed bearings 104. The minimal clearance (preferably about 0.005 inches) between the inner and outer union bodies through the aligned center portions 108 and 114, combined with the sealed bearings 104 positioned at either end of the aligned center portions limit leakage of operating fluid between the outer and inner union bodies, 102 and 100 respectively, to an allowable level without rotating seals separate from the sealed bearings. Thus, the rotary union 46 according to the invention is adapted to provide a clean operating fluid to a rotating member for extended periods of service, without having to service or change rotating seal elements.

It should be noted that in the illustrated form of the invention, the bearings 104 are adapted to fit tightly within the bearing grooves 118 and 120 without any sealing elements. Thus, some leakage between the two union bodies 100 and 102 may be expected in this particular embodiment. To reduce or eliminate leakage between the bearings 104 themselves and the union bodies 100 and 102, suitable sealing elements (not shown) may be provided in the grooves 118 and 120 to seal against the bearings 104. Such seals will be stationary, and thus, should not require substantial maintenance nor introduce contaminants into the operating fluid.

According to the method of the invention, a positional and occluding force is applied to the occluding member carriage 52 in each carriage passageway 50 through an operating fluid supplied from the remote operating fluid supply 18. The method also includes controlling the pressure of the operating fluid so supplied to provide the desired positional and occluding force to each occluding member. This method of providing a variable occlusion in a peristaltic device results in a constant occluding force regardless of changes in the force exerted on the occluding members 54 due to changes in fluid pressure within the tubing 30 being occluded.

The step of applying the desired force to the carriage members 52 includes directing the fluid from the remote operating fluid supply 18 into the rotor 14 to be distributed to each carriage passageway 50. In the preferred form of the invention, operating fluid is directed to the rotary union 46 through the connecting line 136 and then into the rotor drive shaft conduit 88 through the rotary union. From the drive shaft conduit 88, the operating fluid flows into the primary rotor passage 84 and then to each carriage passageway 50 through the rotor connecting passages 86.

With the occluding member carriages 52 and occluding members 54 mounted thereon controlled through the remote operating fluid supply 18, the illustrated peristaltic device 10 may be utilized as a pump, for example. In this application, the motor 16 drives the rotor 14 about its longitudinal axis to move the rollers 54 repeatedly over the tubing 30 (FIG. 4) received in the housing so as to collapse the tubing and urge the fluid within the tubing in the direction of roller movement. It will be readily understood, however, that a peristaltic device according to the invention, as well as the method of providing the variable occlusion therein, may be put to a number of applications.

The method of the invention also preferably includes the step of containing the operating fluid while the positional and occluding force is applied so that the operating fluid does not directly contact the walls of the carriage passageways 50 or the carriage members 52. Such fluid containment is preferably performed by the expandable fluid containment bags 56 positioned in each carriage passageway 50 and shown best in FIGS. 2–4.

In operation, each containment bag 56 is expanded with an increased operating fluid pressure to extend the carriage members 52 as shown in FIG. 4. Each bag 56 is contracted by decreasing the operating fluid pressure so as to retract the occluding members 54 to the position shown in FIG. 3, for example. Also, in the preferred form of the invention, the containment bags 56 include a pleated portion such as the pleat ridge 82 shown in FIGS. 3 and 4 to help facilitate expansion and contraction. The method in this preferred form of the invention includes spreading the pleat ridge 80 to expand the bag, and inwardly folding the pleat ridge to contract the bag.

The above described preferred embodiments are intended to illustrate the principles of the invention, but not to limit the scope of the invention. Various other embodiments and modifications to these preferred embodiments may be made by those skilled in the art without departing from the scope of the following claims.

What is claimed is:

1. A variable occlusion peristaltic apparatus comprising:

A. a housing;

B. an occlusion track being defined in the housing and including a generally arcuate reactive surface, the occlusion track being adapted to receive a loop of tubing extending into the housing through a tubing inlet and exiting the housing through a tubing outlet;

C. a rotor rotatably mounted within the housing and adapted for rotation about a device rotational axis;

D. a rotating machine having a drive shaft connected to the rotor for rotation therewith;

E. a plurality of carriage passageways positioned in the rotor and extending outwardly from the device rotational axis at different angular orientations therefrom toward the arcuate reactive surface of the occlusion track;

F. an occluding member carriage positioned in each carriage passageway having an occluding member mounted thereon, the carriage being adapted for movement through the carriage passageway between a fully retraced position in which the occluding member is positioned generally out of the occlusion track and away from the reactive surface and the tubing in the occlusion track, and an extended position in which the occluding member is positioned so as to bear against and completely collapse the flexible tubing in the occlusion track against the reactive surface; and G. operating fluid distribution means for providing an operating fluid at a desired operating pressure from a remote operating fluid supply to each carriage passageway to control the occlusion force provided by each occluding member against the tubing received in the occlusion track and to control the position of each carriage between the fully retracted and fully extended positions.

2. The apparatus of claim 1 further comprising:

A. expandable operating fluid containment means positioned in each carriage passageway for containing the operating fluid in the passageway so as to prevent direct contact between the operating fluid in the carriage passageway and the carriage and passageway walls.

3. The apparatus of claim 2 wherein the operating fluid containment means includes an expandable bag made of a flexible material with an opening adapted for receiving operating fluid from the operating fluid distribution means.

4. The apparatus of claim 3 wherein the expandable bag includes:

A. a generally planar end section adapted to bear against a generally planar reactive surface of the adjacent occluding member carriage;

B. an open end opposite the planar end section and sealed to a base plate assembly, the fluid receiving opening being formed in the base plate assembly; and C. pleating means formed on the bag between the open end and the planar end section for enabling the length of the bag between the open end and the planar end to vary while maintaining the planar end in contact with the adjacent carriage planar reactive surface and without overstressing the flexible bag material.

5. The apparatus of claim 4 wherein the pleating means includes at least one generally angular pleat ridge on the bag extending inwardly into the carriage passageway, each pleat ridge also extending longitudinally around the entire lateral perimeter of the bag.

6. The apparatus of claim 5 wherein the operating fluid distribution means includes:

A. a primary rotor passage extending longitudinally through the rotor;

B. a drive shaft passage extending longitudinally through the drive shaft and sealingly connected to the primary rotor passage;

C. a plurality of connecting passages formed in the rotor, each connecting passage extending from the primary rotor passage to a different one of the carriage passageways so as to provide fluid communication between the primary rotor passage and the containment bag within each carriage passageway;

D. rotary operating fluid union means for providing operating fluid under the desired pressure from outside the housing to the drive shaft passage; and E. operating fluid supply means for supplying operating fluid at the desired pressure to the rotary operating fluid union means.

7. The apparatus of claim 6 wherein the rotating machine is a suitable rotor drive motor.

8. The apparatus of claim 7 wherein the rotor is elongated and includes more than one longitudinally spaced set of carriage passageways.

9. The apparatus of claim 6 wherein the rotary operating fluid union comprises:

A. an elongated outer union body having an inner opening extending longitudinally therethrough, the inner opening having a center portion with a substantially cylindrical surface;

B. an elongated inner union body having a shaft opening extending longitudinally therethrough for receiving the drive shaft, and also having a center portion with a substantially cylindrical outer surface, the inner union body being adapted to be received within the longitudinal opening of the outer union body with the center portions of the inner and outer union bodies being generally aligned with a small clearance therebetween;

C. sealed bearing means connected between the inner and outer union bodies for suspending the inner union body for rotation within the outer union body with the center cylindrical surface portions of the inner and outer union bodies being generally aligned, and for cooperating with the small clearance between the union body center portions to limit the leakage of operating fluid between the inner and outer union bodies on either side of the aligned center portions; and D. fluid communication means formed in the center portion of the inner and outer union bodies for providing continuous fluid communication transversely through the outer and inner union bodies to the shaft opening of the inner union body, regardless of the angular orientation of the inner union body with respect to the outer union body.

10. The apparatus of claim 9 wherein the fluid communication means includes:

A. a fluid inlet port extending transversely through the center portion of the outer union body from the outer surface thereof to the outer union body inner opening;

B. a fluid outlet port extending transversely through the inner union body from the outer surface of the center portion thereof to the shaft opening; and C. fluid communication groove means formed between the outer and inner union bodies for providing continuous fluid communication between the fluid inlet port through the outer union body and the fluid outlet port through the inner union body.

11. The apparatus of claim 10 wherein the communication groove means includes a groove formed in the cylindrical surface of the center portion of at least one of the union bodies.

12. The apparatus of claim 11 wherein the operating fluid is a suitable gas.

13. A method of providing variable occlusion in a peristaltic device having a housing with an occlusion track defined therein adapted to receive a loop of flexible and resilient tubing extending into the housing through a tubing inlet and exiting through a tubing outlet, and also having a rotor mounted for rotation within the housing, the rotor including a plurality of carriage passageways through which an occluding member carriage and occluding member assembly is adapted to move between an extended position in which said occluding member extends into the occlusion track to fully collapse the tubing therein, and a retracted position in which said occluding member is pulled away from the tubing occlusion track, the method comprising the steps of:

A. applying positional and occluding force to the occluding member carriage in each carriage passageway through an operating fluid supplied from a remote operating fluid supply; and B. controlling the pressure of operating fluid supplied by the remote operating fluid supply to provide the desired positional and occluding force to each occluding member carriage.

14. The method of claim 13 including the step of containing the operating fluid as the fluid pressure is applied to the occluding member carriage in each carriage passageway so that the fluid does not directly contact the walls of the carriage passageway or the carriage.

15. The method of claim 14 wherein the step of containing operating fluid includes containing the fluid in an expandable bag made of flexible material with an open end sealed at one end of the carriage passageway in position for receiving operating fluid.

16. The method of claim 15 wherein the step of containing the operating fluid includes expanding the expandable bag to extend the occluding member carriage and contracting the expandable bag to retract the occluding member carriage.

17. The method of claim 16 wherein the step of expanding the expandable bag includes spreading a pleated portion formed on the sides of the bag.

18. The method of claim 17 wherein the step of contracting the expandable bag includes inwardly folding the pleated portion.

* * * * *